US008157621B2

(12) United States Patent
Chen

(10) Patent No.: US 8,157,621 B2
(45) Date of Patent: Apr. 17, 2012

(54) WAFER BACK SIDE GRINDING PROCESS

(75) Inventor: Jen-Chung Chen, Taipei County (TW)

(73) Assignee: Nanya Technology Corp., Kueishan, Tao-Yuan Hsien (TW)

( * ) Notice: Subject to any disclaimer, the term of this patent is extended or adjusted under 35 U.S.C. 154(b) by 343 days.

(21) Appl. No.: 12/577,712

(22) Filed: Oct. 12, 2009

(65) Prior Publication Data

US 2011/0086580 A1 Apr. 14, 2011

(51) Int. Cl.
*B24B 1/00* (2006.01)
*B24B 7/20* (2006.01)

(52) U.S. Cl. ..... 451/57; 451/41

(58) Field of Classification Search ..... 451/57, 451/63, 41, 59, 54; 156/241, 247, 289, 299, 156/323, 344; 438/458, 459, 690, 691, 692, 438/693, 694, 696
See application file for complete search history.

(56) References Cited

U.S. PATENT DOCUMENTS 5,268,065 A * 12/1993 Grupen-Shemansky ..... 438/118
6,010,951 A * 1/2000 Pushpala et al. ..... 438/458
6,688,948 B2 * 2/2004 Lo ..... 451/41

FOREIGN PATENT DOCUMENTS

CN 101399195 A 4/2009
JP 2008214499 A 9/2008

* cited by examiner

*Primary Examiner* — Dung Van Nguyen
(74) *Attorney, Agent, or Firm* — Winston Hsu; Scott Margo

(57) ABSTRACT

A wafer back side grinding process. A workpiece comprising a first assembly having a first semiconductor wafer and a second assembly having a second semiconductor wafer is provided. A first back side of the first semiconductor wafer is grinded by using the second assembly as a carrier. Thereafter, a second back side of the second semiconductor wafer is grinded.

18 Claims, 9 Drawing Sheets

WAFER BACK SIDE GRINDING PROCESS

BACKGROUND OF THE INVENTION

1. Field of the Invention

The present invention relates generally to wafer processing. More particularly, the present invention relates to an improved wafer back side grinding process.

2. Description of the Prior Art

Three-dimensional (3D) integration is an emerging technology to increase performance and functionality of integrated circuits. Presently 3D die stacking is achieved by wire bonding of stacked die or bumped stack die technologies. The Through-Silicon-Via (TSV) stacked die concept is an emerging technology which requires wafer-to-wafer or wafer-to-support system (carrier) bonding.

By using TSV technology, 3D ICs can pack a great deal of functionality into a small footprint. In addition, critical electrical paths through the device can be drastically shortened, leading to faster operation and better performance.

After TSV process, the wafer is ordinarily subjected to wafer thinning or wafer back side grinding process in order to reduce the thickness of the wafer. However, the conventional wafer back side grinding process has several drawbacks. For example, the conventional wafer back side grinding process has low throughput because the wafer support system (WSS) typically handles one piece of wafer at one time. The conventional wafer support system typically requires a silicon or glass carrier that adds production expense.

Therefore, there is a need in this industry to provide an improved wafer thinning or wafer back side grinding process, which is cost-effective and provides high throughput and reduced process time per wafer.

SUMMARY OF THE INVENTION

It is one objective of the present invention to provide an improved wafer back side grinding process in order to solve the above-mentioned prior art problems.

It is another objective of the present invention to provide an improved wafer back side grinding process that can save wafer load and unload time, thereby improving production efficiency and throughput.

It is still another objective of the present invention to provide an improved wafer back side grinding process that does not need conventional silicon or glass carrier, thereby reducing production cost.

In one aspect of the present invention, there is provided a wafer back side grinding process including: providing a workpiece comprising a first assembly having a first semiconductor wafer and a second assembly having a second semiconductor wafer; grinding a first back side of the first semiconductor wafer by using the second assembly as a carrier; and grinding a second back side of the second semiconductor wafer.

From another aspect, a wafer back side grinding process includes: providing a workpiece comprising a first assembly having a first semiconductor wafer and a second assembly having a second semiconductor wafer, wherein the first and second assemblies are bonded together with at least one hot melt adhesive layer; loading the workpiece into a wafer grinder; grinding a first back side of the first semiconductor wafer by using the second assembly as a carrier; grinding a second back side of the second semiconductor wafer; and unloading the workpiece from the wafer grinder.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
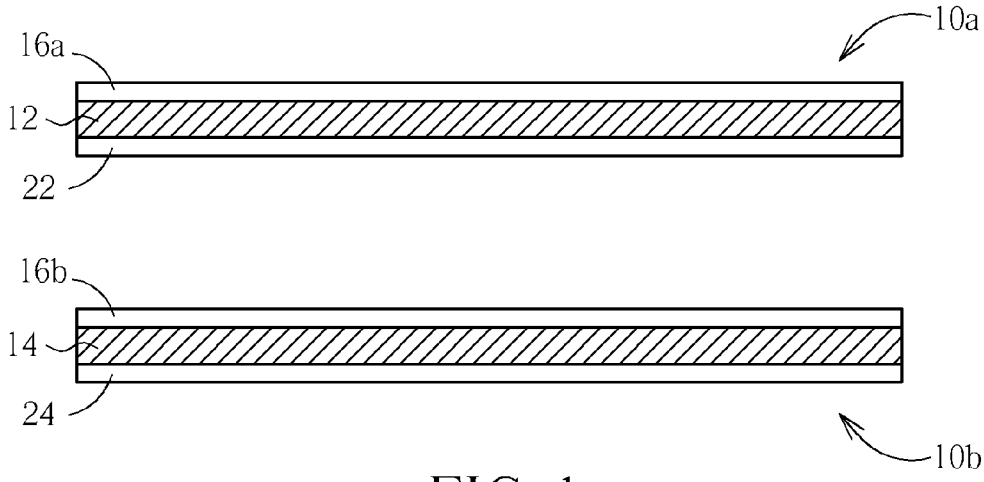
FIG. 1 to FIG. 10 are schematic, cross-sectional diagrams showing an exemplary wafer back side grinding process in accordance with one preferred embodiment of this invention.

Please refer to FIG. 1 to FIG. 10. FIG. 1 to FIG. 10 are schematic, cross-sectional diagrams showing an exemplary wafer back side grinding process in accordance with one preferred embodiment of this invention. As shown in FIG. 1, a first intermediate support substrate 10*a* and a second intermediate support substrate 10*b* are provided. The first intermediate support substrate 10*a* comprises a multi-layer film stack comprising a first polymer film 12, a first hot melt adhesive layer 16*a* laminated on an upper major surface of the first polymer film 12, and a first ultraviolet (UV) sensitive adhesive layer 22 laminated on a lower major surface of the first polymer film 12.

The second intermediate support substrate 10*b* likewise comprises a multi-layer film stack comprising a second polymer film 14, a second hot melt adhesive layer 16*b* laminated on an upper major surface of the second polymer film 14, and a second UV-sensitive adhesive layer 24 laminated on a lower major surface of the second polymer film 14.

According to the preferred embodiment of this invention, in order to provide adequate mechanical strength for supporting a thinned wafer, each of the first polymer film 12 and the second polymer film 14 may have a thickness of about 200-700 μm, preferably, 500 μm, for example.

In addition, both of the first polymer film 12 and the second polymer film 14 are made of solvent-resistant and heat-resistant polymer materials including but not limited to, for example, polyimide (PI), polyolefine (PO), poly-acrylonitrile (PAN) or the like. However, it is understood that the first polymer film 12 and the second polymer film 14 may be made of different polymer materials.

According to the preferred embodiment of this invention, the first hot melt adhesive layer 16*a* and the second hot melt adhesive layer 16*b* may be composed of thermoplastic resins or any suitable types of hot melt adhesive materials such as hot melt pressure sensitive adhesives. The first and second UV-sensitive adhesive layers 22 and 24 may be UV sensitive tapes.

Figure 2:
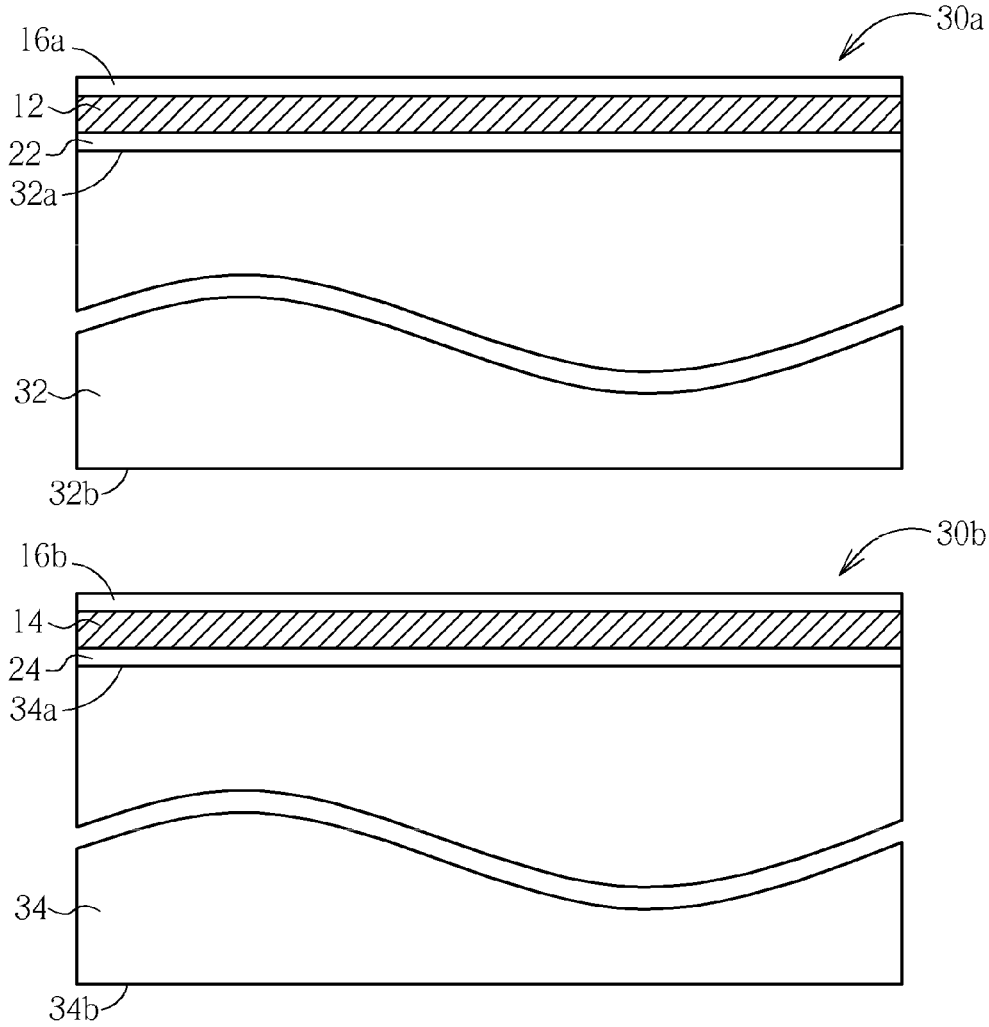

As shown in FIG. 2, an active side 32*a* of a first semiconductor wafer 32 is then bonded to the first UV-sensitive adhesive layer 22 of the first intermediate support substrate 10*a* to thereby form a first assembly 30*a*. The back side 32*b* of the first semiconductor wafer 32 is exposed. Typically, the first semiconductor wafer 32 has a thickness of about 600-800 μm, for example, 700 μm.

Likewise, an active side 34*a* of a second semiconductor wafer 34 is then bonded to the second UV-sensitive adhesive layer 24 of the second intermediate support substrate 10*b* to thereby form a second assembly 30*b*. The back side 34*b* of the second semiconductor wafer 34 is exposed. Typically, the second semiconductor wafer 34 has a thickness of about 600-800 μm, for example, 700 μm.

The first assembly 30*a* comprises the first semiconductor wafer 32 that is secured to the first intermediate support substrate 10*a* with first UV-sensitive adhesive layer 22. The second assembly 30*b* comprises the second semiconductor wafer 34 that is secured to the second intermediate support substrate 10*b* with second UV-sensitive adhesive layer 24.

Figure 3:
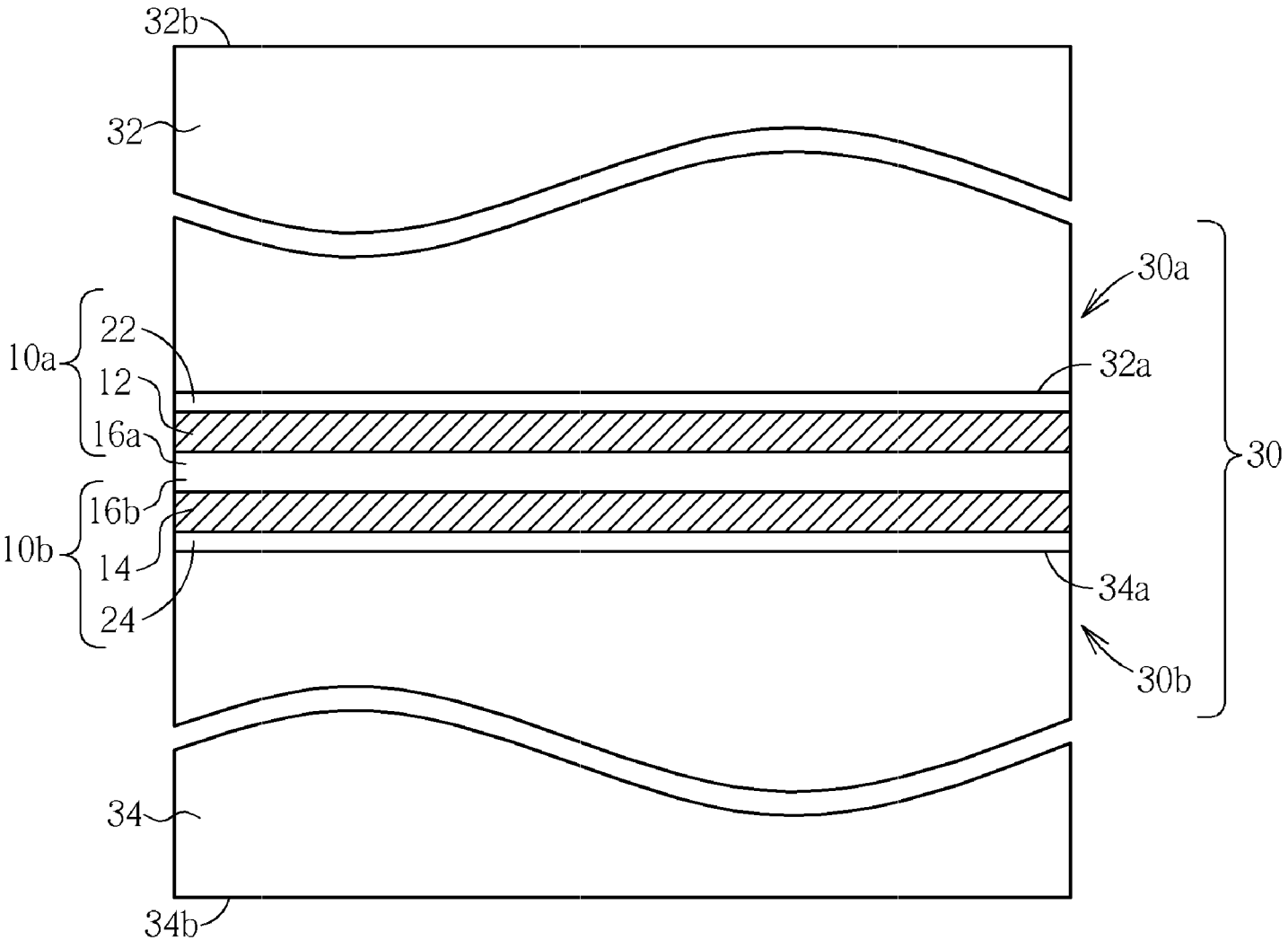

Subsequently, as shown in FIG. 3, the first assembly 30*a* and the second assembly 30*b* are bonded together with the first hot melt adhesive layer 16*a* and the second hot melt adhesive layer 16*b* to form a workpiece 30. To facilitate the bonding between the first assembly 30*a* and the second assembly 30*b*, the first hot melt adhesive layer 16*a* and the second hot melt adhesive layer 16*b* may be heated up to a temperature of about 120° C., but not limited thereto.

Figure 4:
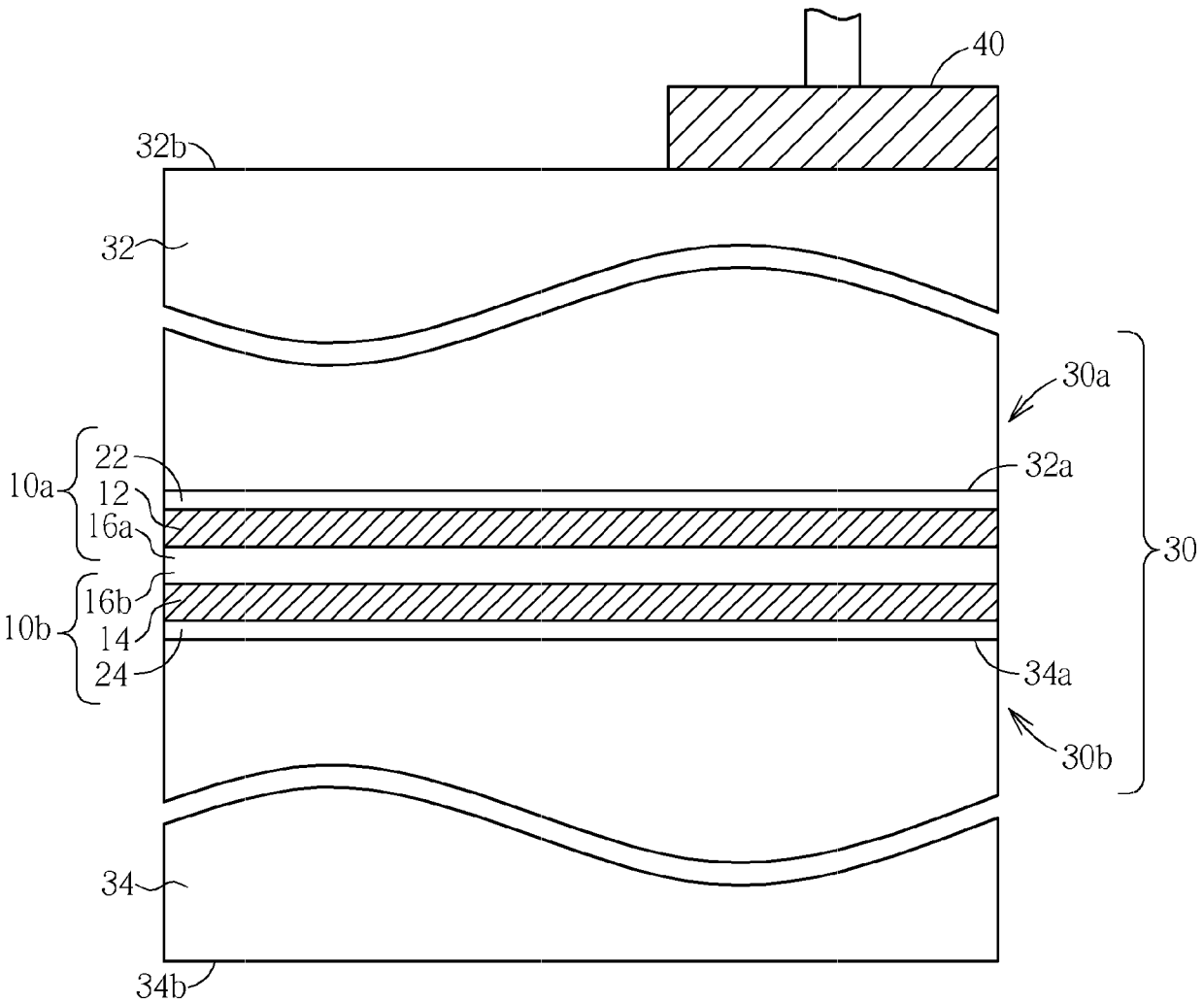
Figure 5:
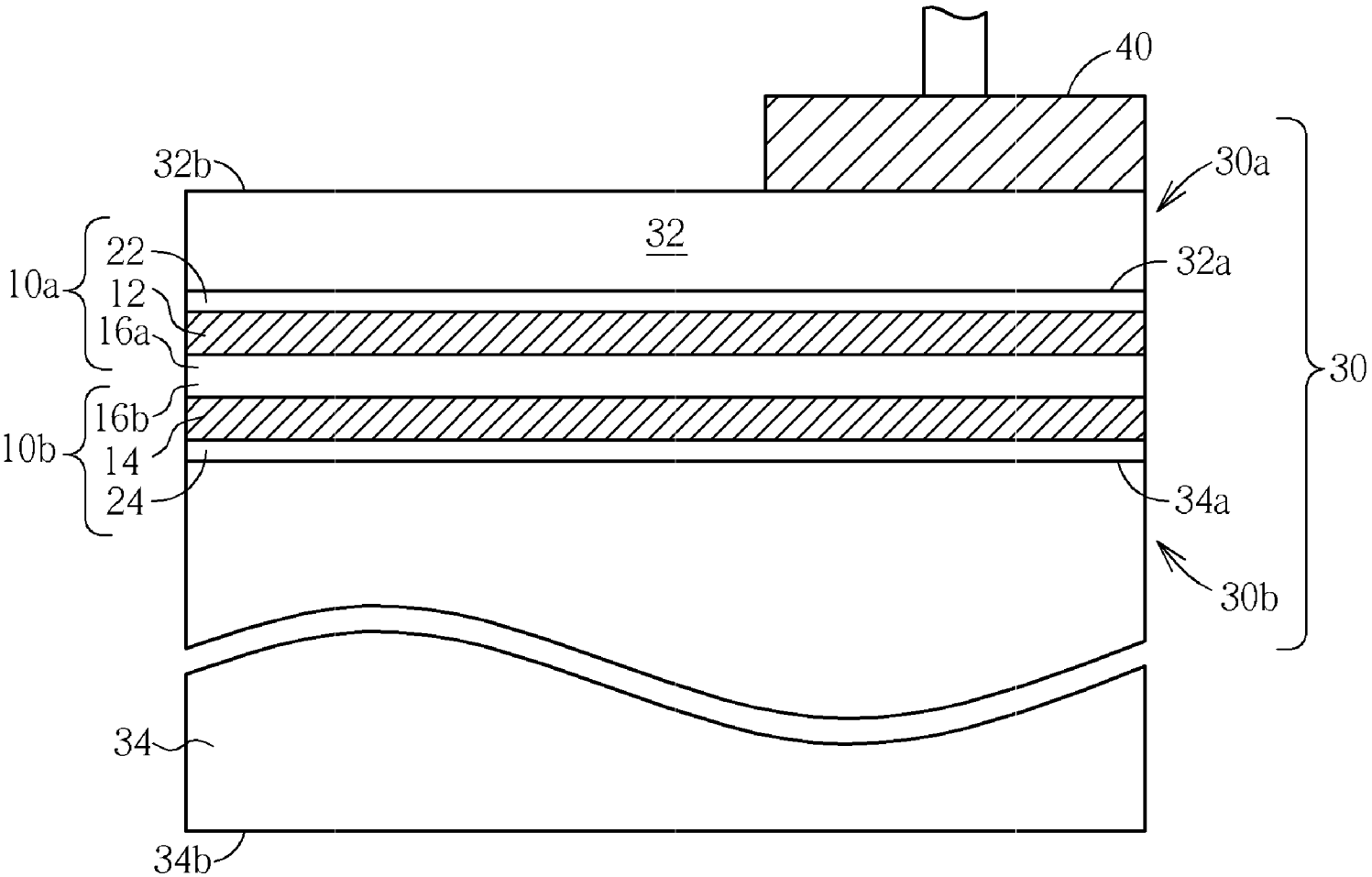

As shown in FIG. 4 the workpiece 30 comprising the first semiconductor wafer 32 and the second semiconductor wafer 34 is then subjected to wafer back side grinding and milling. For example, the workpiece 30 is first loaded into a wafer grinder (nor explicitly shown), then a polishing pad 40 is in contact with the back side 32*b* of the first semiconductor wafer 32 and starts to grind the back side 32*b*. The grinding or milling process reduces the thickness of the first semiconductor wafer 32, as shown in FIG. 5. By way of example, after the grinding or milling process, the remaining first semiconductor wafer 32 has a thickness of about 50 μm. During the grinding or milling of the first semiconductor wafer 32, the second assembly 30*b* may act as a carrier for a wafer support system.

Figure 6:
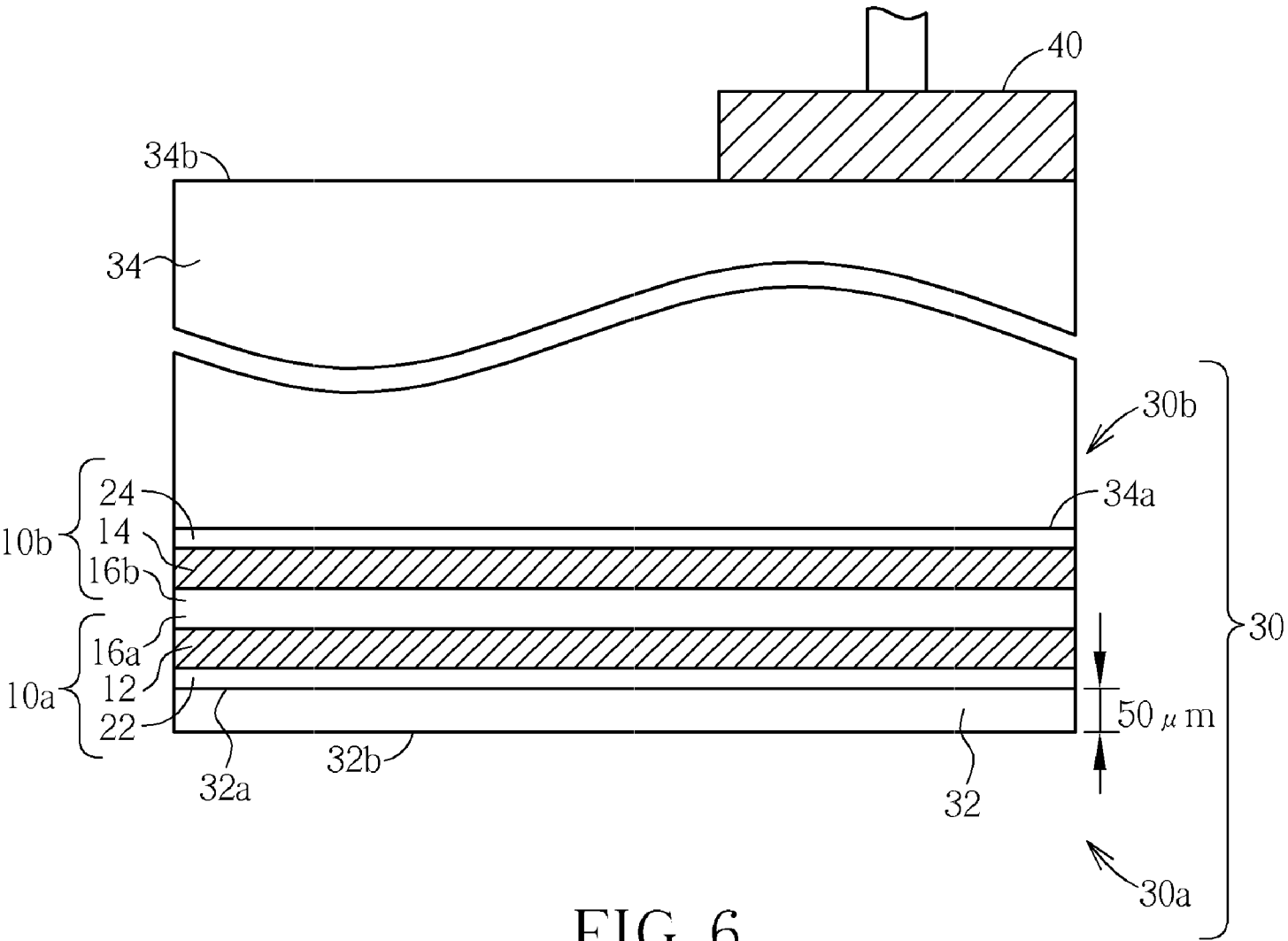
Figure 7:
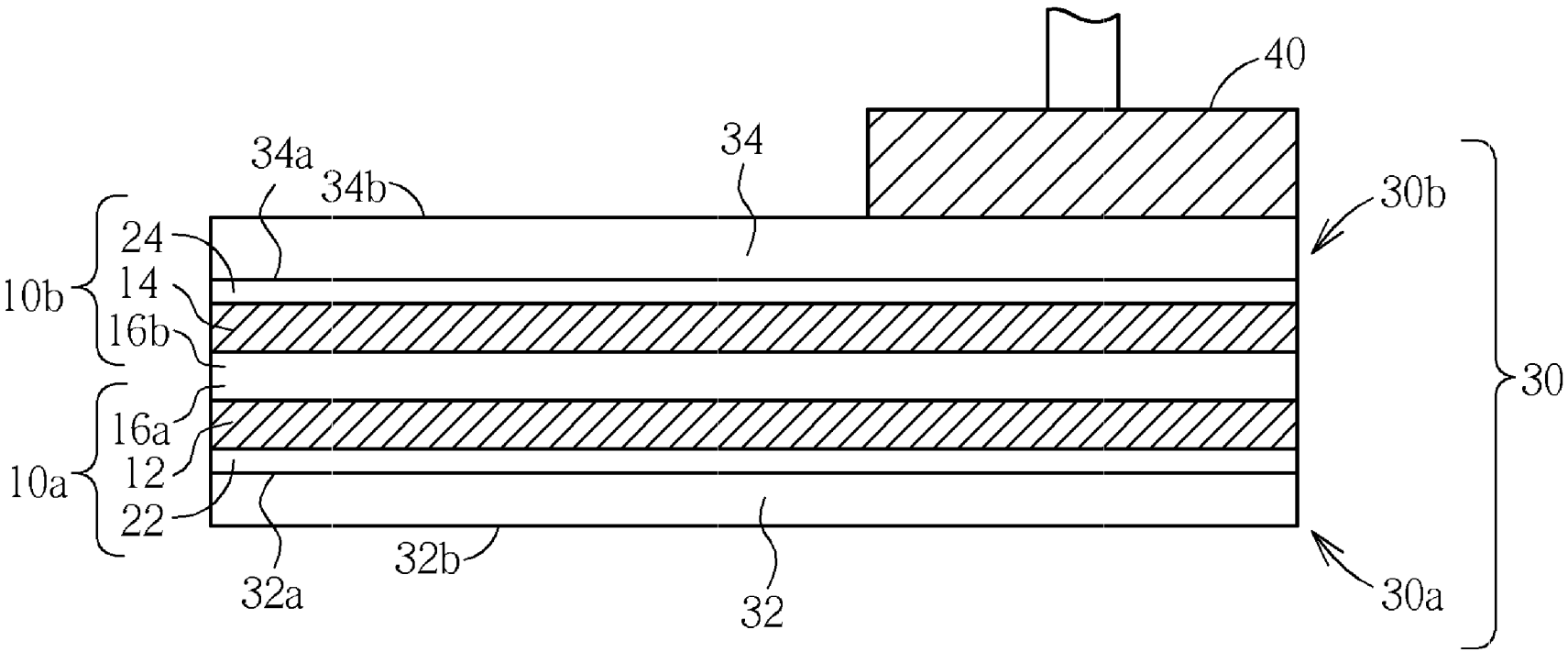

As shown in FIG. 6 and FIG. 7, the same process steps are carried out on the second semiconductor wafer 34. As shown in FIG. 6, after the grinding or milling of the first semiconductor wafer 32 is finished, the workpiece 30 is then reversed such that the back side 34*b* of the second semiconductor wafer 34 is now in contact with the polishing pad 40. The polishing pad 40 polishes the back side 34*b* of the second semiconductor wafer 34 until a desired thickness is achieved, for example, 50 μm, as shown in FIG. 7.

Figure 8:
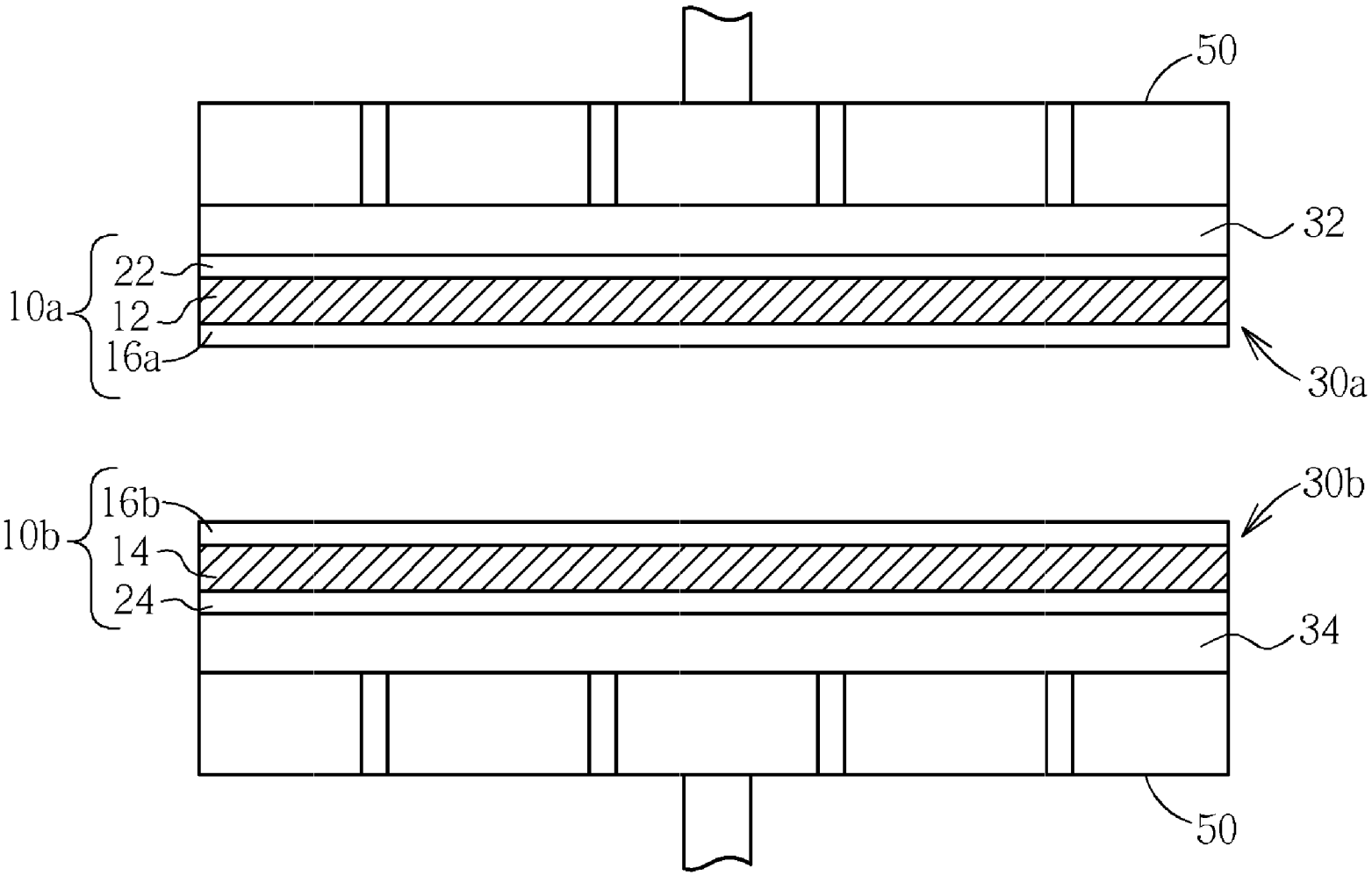

As shown in FIG. 8, after the grinding or milling of the first and second semiconductor wafers 32 and 34 is finished, the workpiece 30 is unloaded from the wafer grinder. A wafer separation process is then carried out. For example, the workpiece 30 is heated up to a temperature of about 120° C., for example, in order to melt the hot melt adhesive layer 16*a* and 16*b*. Thereafter, the first and second semiconductor wafers 32 and 34 are separated from each other by vacuum plates 50 or other suitable means such as a wafer chuck.

Figure 9:
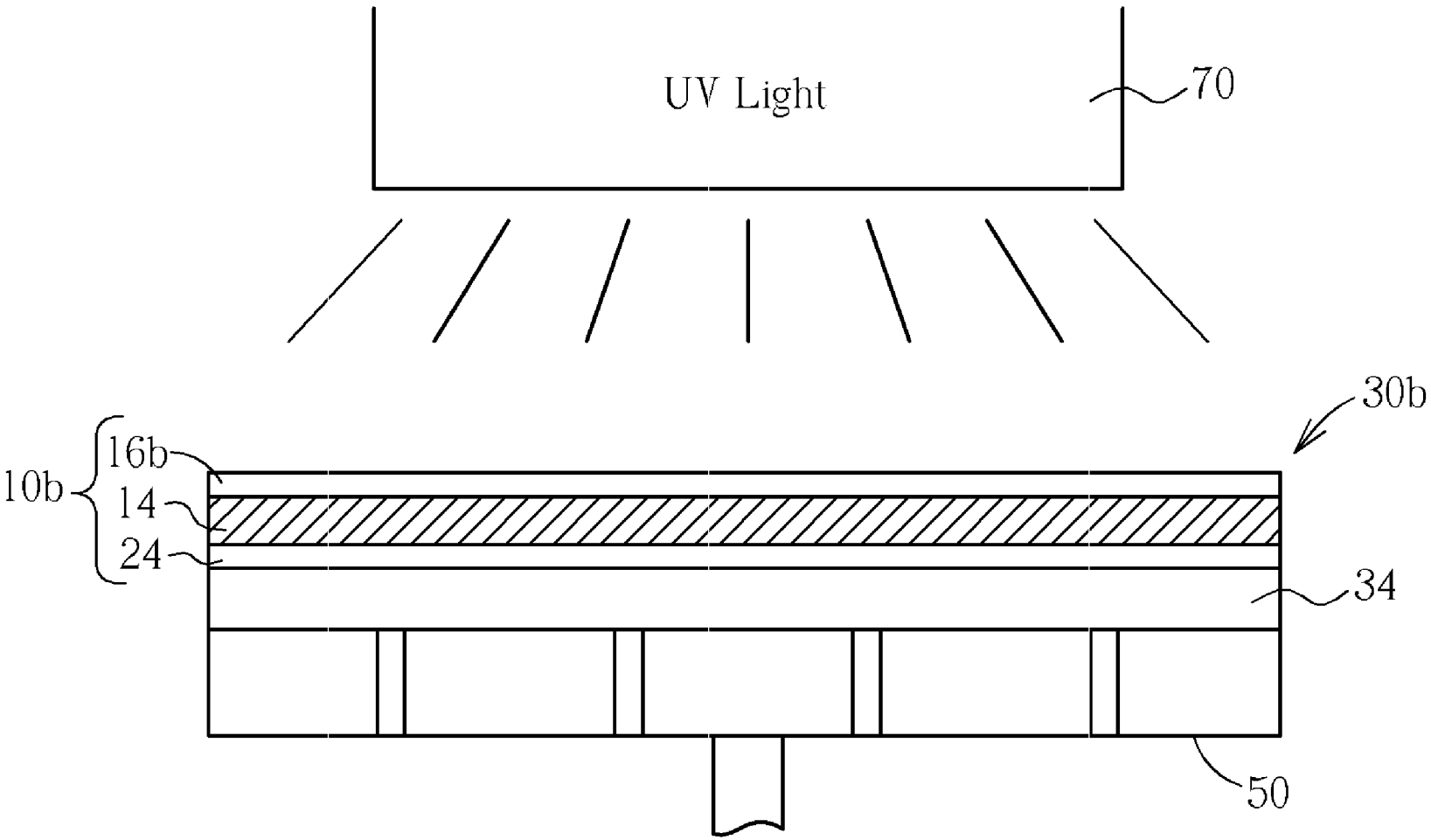
Figure 10:
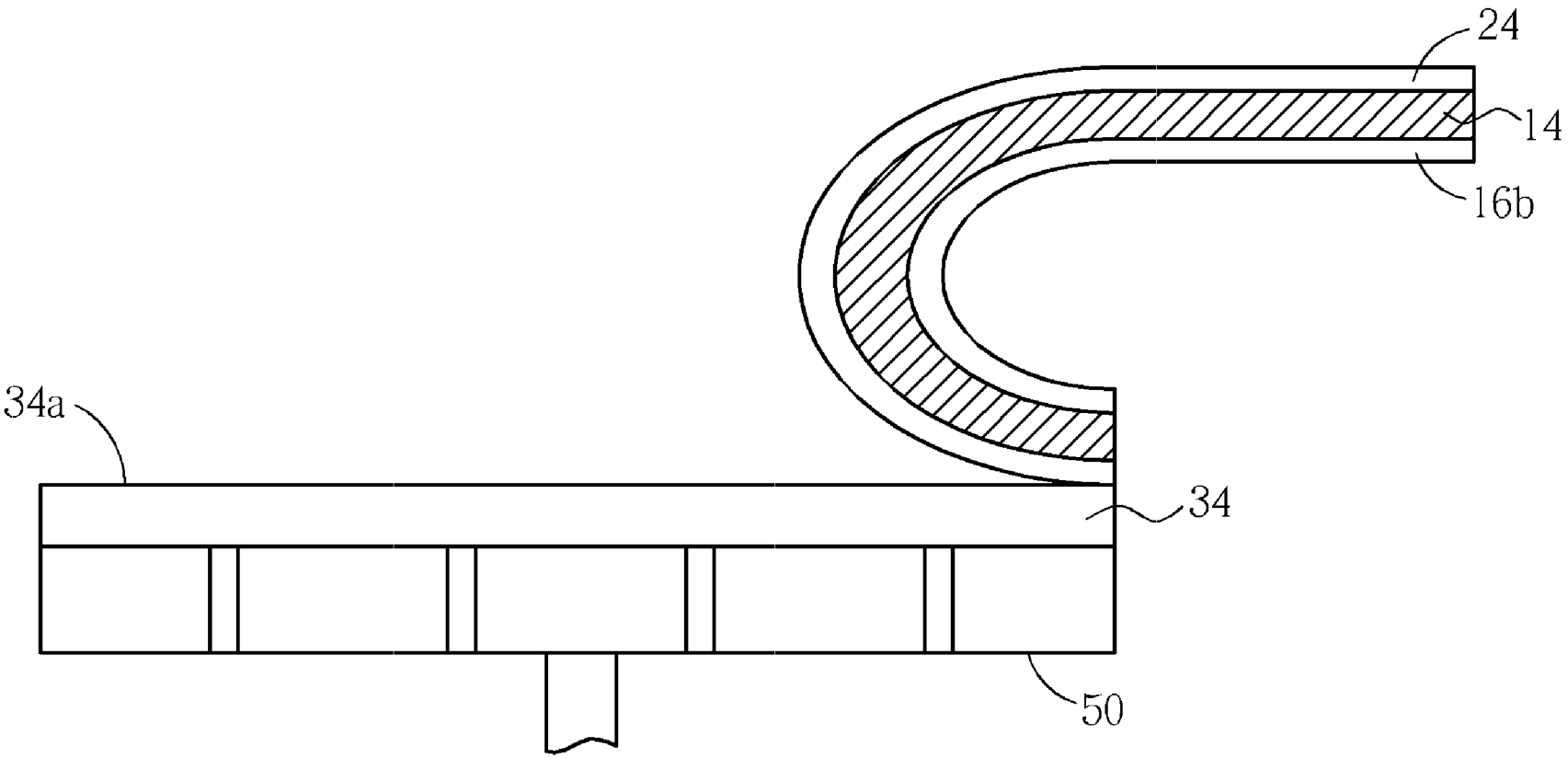

FIG. 9 and FIG. 10 show the steps for removing the intermediate support substrate from the active surface of the semiconductor wafer, taking the second assembly 30*b* as an example. As shown in FIG. 9, after the wafer separation process, the second assembly 30*b*, for example, is subjected to UV light irradiation. The second UV-sensitive adhesive layer 24 is irradiated with UV rays from an UV lamp 70, for example. By irradiating the second UV-sensitive adhesive layer 24 with the ultraviolet rays, the UV tape become less adhesive. This facilitates the removal of the second UV-sensitive adhesive layer 24 from the active surface 34*a* of the second semiconductor wafer 34.

As shown in FIG. 10, the second UV-sensitive adhesive layer 24 is peeled off from the second semiconductor wafer 34. For example, the second UV-sensitive adhesive layer 24 may be peeled off in a remover. It is understood that the same process steps may be carried out on the first assembly 30*a* in order to remove the first intermediate support substrate 10*a* from the active surface 32*a* of the first semiconductor wafer 32.

Those skilled in the art will readily observe that numerous modifications and alterations of the device and method may be made while retaining the teachings of the invention.

What is claimed is:

1. A wafer back side grinding process, comprising:

providing a workpiece comprising a first assembly having a first semiconductor wafer and a second assembly having a second semiconductor wafer, wherein the first and second assemblies are bonded together with at least one hot melt adhesive layer between active sides of the first and second semiconductor wafers;

grinding a back side of the first semiconductor wafer by using the second assembly as a carrier; and grinding a back side of the second semiconductor wafer.

2. The wafer back side grinding process according to claim 1, wherein the first assembly comprises a first intermediate support substrate that is secured to the active side of the first semiconductor wafer.

3. The wafer back side grinding process according to claim 2, wherein the first intermediate support substrate comprises a first polymer film, a first hot melt adhesive layer laminated on an upper major surface of the first polymer film, and a first ultraviolet (UV) sensitive adhesive layer laminated on a lower major surface of the first polymer film.

4. The wafer back side grinding process according to claim 3, wherein the first polymer film has a thickness of about 200-700 μm.

5. The wafer back side grinding process according to claim 3, wherein the first polymer film comprises polyimide (PI), polyolefine (PO) or poly-acrylonitrile (PAN).

6. The wafer back side grinding process according to claim 1, wherein the second assembly comprises a second intermediate support substrate that is secured to the active side of the second semiconductor wafer.

7. The wafer back side grinding process according to claim 6, wherein the second intermediate support substrate comprises a second polymer film, a second hot melt adhesive layer laminated on an upper major surface of the second polymer film, and a second ultraviolet (UV) sensitive adhesive layer laminated on a lower major surface of the second polymer film.

8. The wafer back side grinding process according to claim 7, wherein the second polymer film has a thickness of about 200-700 μm.

9. The wafer back side grinding process according to claim 7, wherein the second polymer film comprises polyimide (PI), polyolefine (PO) or poly-acrylonitrile (PAN).

10. A wafer back side grinding process, comprising:

providing a workpiece comprising a first assembly having a first semiconductor wafer and a second assembly having a second semiconductor wafer, wherein the first and second assemblies are bonded together with at least one hot melt adhesive layer between active sides of the first and second semiconductor wafers;

loading the workpiece into a wafer grinder;

grinding a back side of the first semiconductor wafer by using the second assembly as a carrier;

grinding a back side of the second semiconductor wafer; and unloading the workpiece from the wafer grinder.

11. The wafer back side grinding process according to claim 10, wherein the first assembly comprises a first intermediate support substrate that is secured to the active side of the first semiconductor wafer.

12. The wafer back side grinding process according to claim 11, wherein the first intermediate support substrate comprises a first polymer film, a first hot melt adhesive layer laminated on an upper major surface of the first polymer film, and a first ultraviolet (UV) sensitive adhesive layer laminated on a lower major surface of the first polymer film.

13. The wafer back side grinding process according to claim 12, wherein the first polymer film has a thickness of about 200-700 μm.

14. The wafer back side grinding process according to claim 12, wherein the first polymer film comprises polyimide (PI), polyolefine (PO) or poly-acrylonitrile (PAN).

15. The wafer back side grinding process according to claim 10, wherein the second assembly comprises a second intermediate support substrate that is secured to the active side of the second semiconductor wafer.

16. The wafer back side grinding process according to claim 15, wherein the second intermediate support substrate comprises a second polymer film, a second hot melt adhesive layer laminated on an upper major surface of the second polymer film, and a second ultraviolet (UV) sensitive adhesive layer laminated on a lower major surface of the second polymer film.

17. The wafer back side grinding process according to claim 16, wherein the second polymer film has a thickness of about 200-700 μm.

18. The wafer back side grinding process according to claim 16, wherein the second polymer film comprises polyimide (PI), polyolefine (PO) or poly-acrylonitrile (PAN).

* * * * *